US006524408B1

(12) United States Patent
Schmitz et al.

(10) Patent No.: US 6,524,408 B1
(45) Date of Patent: Feb. 25, 2003

(54) METHOD FOR PRODUCING LOAD-OPTIMIZED STEEL STRIPS

(75) Inventors: Wilhelm Schmitz, Baesweiler (DE); Dieter Senk, Duisburg (DE); Ulrich Albrecht-Früh, Willich (DE); Reiner Kopp, Aachen (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 09/786,230

(22) PCT Filed: Aug. 27, 1999

(86) PCT No.: PCT/EP99/06303

§ 371 (c)(1),
(2), (4) Date: Jun. 18, 2001

(87) PCT Pub. No.: WO00/13820

PCT Pub. Date: Mar. 16, 2000

(30) Foreign Application Priority Data

Aug. 9, 1998 (DE) ..... 198 40 898

(51) Int. Cl.[7] ..... C21D 8/02; B22D 11/00

(52) U.S. Cl. ..... 148/541; 148/546; 148/547; 164/475; 164/476; 164/477; 164/480

(58) Field of Search ..... 148/541, 546, 148/547; 164/475, 476, 477, 480

(56) References Cited

U.S. PATENT DOCUMENTS 5,901,777 A * 5/1999 Matsumura et al. ..... 164/475

FOREIGN PATENT DOCUMENTS

| | | | |
|---|---|---|---|
| JP | 36019249 A | * 10/1985 | ..... 164/463 |
| JP | 61-266159 A | 11/1986 | |
| JP | 02-052150 A | 2/1990 | |
| JP | 07-276004 A | 10/1995 | |

* cited by examiner

*Primary Examiner*—Deborah Yee
(74) *Attorney, Agent, or Firm*—Proskauer Rose LLP

(57) ABSTRACT

To produce sheet steel components optimised for loading, a steel strip is cast between two cooled rolls with a variable nip and the thickness of the steel strip is changed by changing the time of contact between the strand shells and the rolls or by changing the cooling intensity of the rolls on the molten steel cast into the gusset formed by the rolls, thereby changing the thickness of the steel strip. Such a strip has a homogeneous structure and can subsequently be given a special quality by hot or cold rolling for its particular purpose of use.

9 Claims, 1 Drawing Sheet

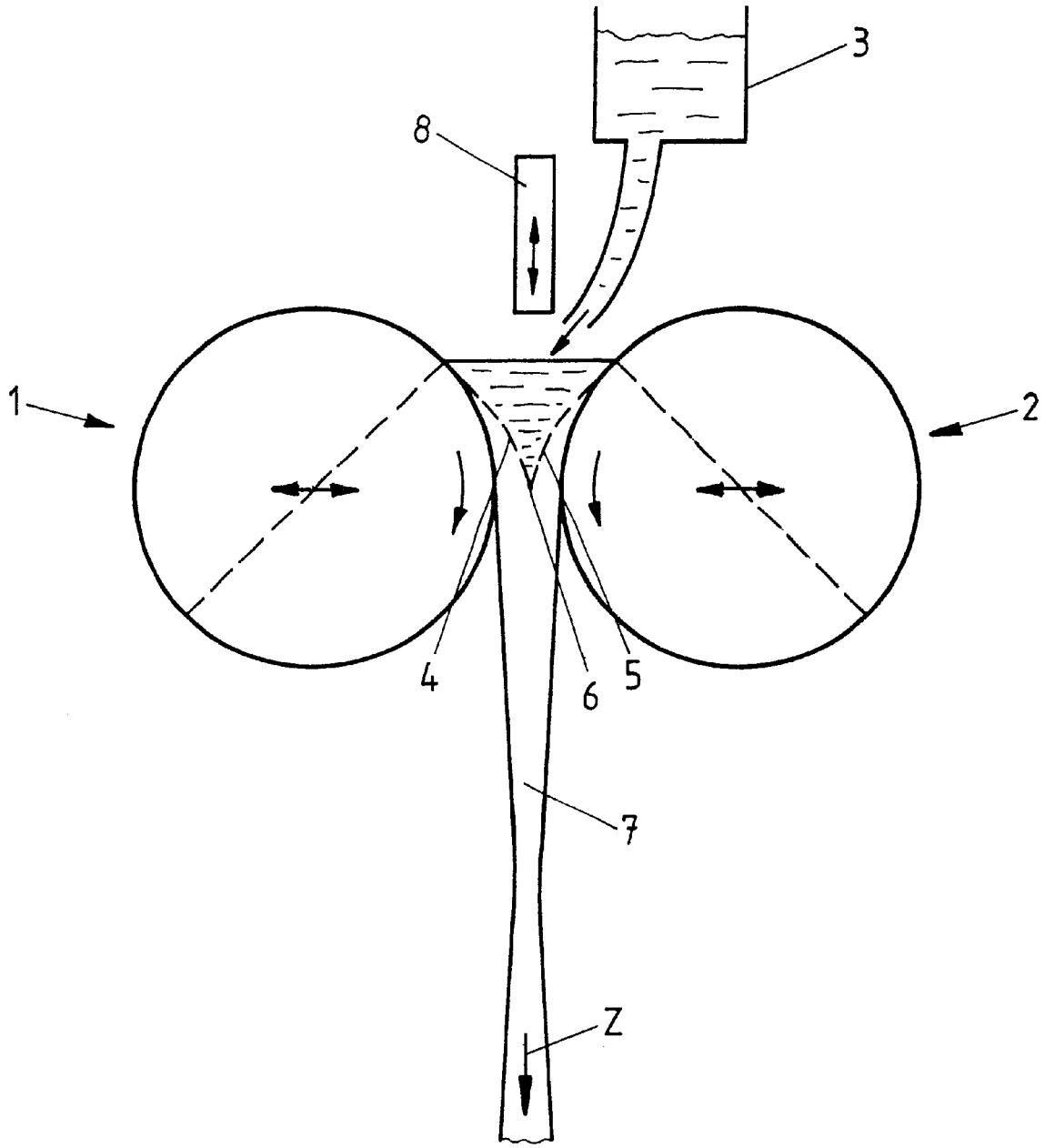
3
8
1
2
4
6
5
7
Z

METHOD FOR PRODUCING LOAD-OPTIMIZED STEEL STRIPS

For the purpose of economising raw materials and energy, for many years attempts have been made to produce constructional components optimised for loading. More particularly in the case of motor vehicles, in which weight plays an outstanding role in fuel consumption, these efforts have led to the use of components produced from tailored blanks at different places on the motor vehicle. Such components consist of sheet metal parts of different thicknesses welded together. Of course, due to the sudden change in thickness are not at every place optimum from the aspect of subsequent loading.

To obtain components optimised for loading and free from such a sudden change in thickness, very recently tests have been carried out on so-called flexible cold rolling—i.e., a cold rolling of strips, wherein the nip between the rolls is changed in dependence on the travel of the strip passing through. (B. Hachmann, R. Kopp, Aachen, "Rolling of longitudinal sections optimised for loading", pages 4.2-1 to 4.2-6, "Umformtechnik", (=Shaping Technology), 7th Aachen Steel Colloquium, Mar. 26 to 27, 1992, Institut fur Bildsame Formgebung (=Institute of Ductile Shaping), Rhineland-Westphalia Technical University, Aachen). However, these tests have not yet led to results usable in practice. Apart from the difficulty of reaching the high rolling forces required, another difficulty is that during cold rolling the strips are subjected to different degrees of shaping over strip length. The different solidification associated therewith is undesirable for the majority of applications.

Patent Abstracts of Japan, vol. 011, no. 125. (M-582) also discloses the starting-up of a continuous strip casting installation, wherein during the start-up the nip formed between water-cooled rolls is gradually increased in size, the casting speed being simultaneously so increased as to achieve a constant thickness in the strand shells. In that process the object is not to produce strips having a thickness constantly changing in the longitudinal direction of the strip.

It is an object of the invention to provide for the production of steel strips optimised for loading a process which both allows the steel strips to be used directly and also to be further shaped without the aforedescribed disadvantages during cold rolling.

The invention therefore relates to a process for the production of steel strips optimised for loading and having a thickness continuously changing in the longitudinal direction of the strip. According to the invention such a process is characterised in that the steel strip is produced by casting between two cooled rolls with a variable nip and, in dependence on the travel of the cast strip passing through, the cooling of the rollers acting on the molten steel cast into the gusset formed by the rollers and therefore the thickness of the steel strip are so changed as to give the steel strip a length-related change in thickness of 10 to 40%.

A steel strip of homogeneous structure but having a thickness differing over its length can be produced by the process according to the invention. Such a strip provides the best preconditions for subsequent further shaping treatment either by hot rolling, or more particularly by cold rolling. Constant degrees of shaping can be achieved without problems if the strip is cold rolled.

In embodiments of the invention there are different possible ways of adjusting the thickness of the strip via the cooling of the rolls. In one possible embodiment of the invention the cooling performed by the rollers is influenced via their time of contact with the molten steel. In actual fact this can be done by adjusting the peripheral speed of the rolls and/or via the level of the molten metal. However, an alternative possibility is that the cooling is influenced via the heat flow between the rolls and the molten steel. In actual fact this can be done via the surface structure of the rolls and/or an inert gas atmosphere and/or casting oil.

Since the thickness of the strip is influenced by the cooling of the rolls and therefore via the strand shells of the strip in course of formation, a simple adjustment of the supporting force is advisable—i.e., the rolls can be acted upon with a constant to slightly increasing supporting force. If the strip is to become thicker, cooling is increased, with the consequence of thicker strand shells. This means that the rolls yield backwards and form a large nip. Conversely, the supporting rolls adjust if cooling is diminished, so that the strand shells become thinner. In any case this procedure ensures that the strand shells contact one another and become welded to one another at the so-called kissing point—i.e., the opposite apices of the rolls.

If the cast strip is to be further reduced in thickness, it can be hot rolled. Moreover, the structure of the strip can be influenced more particularly via cold rolling and also via possible recrystallisation annealing.

BRIEF DESCRIPTION OF THE DRAWINGS

FIG. 1 shows a diagram of the process to produce steel strips having varied thickness in longitudinal direction.

The invention will now be explained in greater detail with reference to an embodiment of an apparatus, shown in the drawing, suitable for the process according to the invention.

Two cooled rolls 1, 2 driven to opposite hands form a nip therebetween. Above the nip they form a gusset into which molten steel is cast from a casting tank 3. The molten steel solidifies in the zones adjacent the cooled rolls 1, 2, so that strand shells 4, 5 are formed which meet at the narrowest place of the nip (the so-called kissing point 6). At this A place the strand shells 4, 5 become welded to one another to form a strip 7 which is drawn off in the direction indicated by arrow Z.

To produce a strip 7 having varying thickness in its longitudinal direction, the distance between the rolls 1, 2 must be variable. Moreover, strand shells 4, 5 of different thicknesses must be formed via the cooling exerted by the rolls 1, 2 on the molten steel. There are a number of possible ways of influencing cooling. For example, cooling can be influenced via the heat flow from the cooled rolls 1, 2 to the molten steel. In the embodiment illustrated segmented rolls 1, 2 are shown whose segments can have a differing surface structure in the segments. However, they might also be cooled to a different extent. However, cooling can also be influenced by changing the inert gas forming the atmosphere in which casting takes place. However, influencing is also possible via the casting oil which may be present between the generated surfaces of the rolls and the melt. A particularly effective and rapidly reacting result as regards cooling can however be obtained by changing the time of contact between the rolls 1, 2 and the molten steel. For example, the level of the molten metal can be rapidly influenced via an immersion member 8 acting as a displacing element. The immersion member should be adiabatic, more particularly be made of ceramics. Lastly, however, influencing is also possible via the peripheral speed of the rolls 1, 2. In these last two cases cooling is influenced via the time of contact between the rolls 1, 2 and the molten metal. A reduction in the peripheral speed produces a longer time of contact, so that the strand shells become thicker, while increasing the peripheral speed makes the time of contact shorter and therefore the strand shells thinner.

The distance between the rollers 1, 2 can be adjusted by adjusting members (not shown). Preferably the adjusting members operate with a constant supporting force, or with one which becomes slightly greater with an increased distance. In that case adjustment of the correct distance is particularly simple, since the width of the nip is adjusted spontaneously in dependence on the thickness of the strand shells 4, 5. Basically, with a rigid stand a small $\Delta S$ for the thickness of the strip corresponds to a large $\Delta K$ for the rolling force, and with a soft stand a large $\Delta S$ corresponds to a small $\Delta K$.

The strip 7 leaving the strip casting installation with a thickness becoming gradually greater and smaller in the direction in which the strip runs has a homogeneous structure and can then be used immediately or changed by further shapings, such as hot rolling or cold rolling. In any case, due to its homogeneous structure the strip provides optimum preconditions for further processing.

What is claimed is:

1. A process for producing steel strips optimized for loading and having a thickness continuously changing in the longitudinal direction of the strip comprising:

casting a molten steel cast between two cooled rolls with a variable nip, wherein the two cooled rolls are subjected to a supporting force, so that a strand shell moves against another strand shell until they touch each other;

cooling the molten steel cast by a cooling action of the two cooled rolls depending upon a travel of the molten steel cast into a gusset formed by the two cooled rolls; and producing the steel strips by changing the thickness of the molten steel cast so as to give the steel strips a length-related change in thickness of 10 to 40%.

2. A process according to claim 1, wherein the two cooling rolls are subjected to a constant force.

3. A process according to claim 1, wherein the cooling performed by the two cooled rolls depends upon their time of contact with the molten steel cast.

4. A process according to claim 1, wherein the cooling is influenced via a heat flow between the two cooled rolls and the molten steel cast.

5. A process according to claim 1, wherein the molten steel cast is hot rolled from a casting heat.

6. A process according to claim 1, wherein the molten steel cast is cold rolled immediately after at least one between hot rolling and recrystallization annealing.

7. A process according to claim 3, wherein the time of contact is adjusted via at least one between a speed of the two cooled rolls and a level of a bath of the molten steel cast.

8. A process according to claim 4, wherein the heat flow is influenced via at least one between a surface structure of the two cooled rolls, an inert gas atmosphere and a casting oil.

9. A process according to claim 6, wherein at least one between hot rolling and cold rolling are performed with a constant degree of shaping after previous recrystallization annealing.

* * * * *